US006272832B1

(12) United States Patent
Göbbels et al.

(10) Patent No.: US 6,272,832 B1
(45) Date of Patent: Aug. 14, 2001

(54) SERVICE UNIT FOR A CHEESE-PRODUCING TEXTILE MACHINE

(75) Inventors: Heinz-Dieter Göbbels; Bert Hurtz, both of Mönchengladbach (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/552,271

(22) Filed: Apr. 19, 2000

(30) Foreign Application Priority Data

Apr. 21, 1999 (DE) ..... 199 17 968

(51) Int. Cl.[7] ..... D01H 13/26
(52) U.S. Cl. ..... 57/263
(58) Field of Search ..... 57/262, 263, 261, 57/264

(56) References Cited

U.S. PATENT DOCUMENTS

| | | | | |
|---|---|---|---|---|
| 4,050,226 | | 9/1977 | Brozková et al. | 57/34 R |
| 4,178,749 | | 12/1979 | Stahlecker et al. | 57/263 |
| 4,712,367 | | 12/1987 | Lassmann | 57/263 |
| 4,920,739 | | 5/1990 | Raasch | 57/263 |
| 5,463,860 | | 11/1995 | Sauer | 57/263 |
| 5,535,580 | | 7/1996 | Sebastian et al. | 57/263 |
| 5,582,354 | * | 12/1996 | Peters | 242/35.5 A |
| 5,584,170 | * | 12/1996 | Stahlecker | 57/263 |
| 5,634,602 | | 6/1997 | Göbbels et al. | 242/18 PW |
| 5,772,136 | * | 6/1998 | Gilbos et al. | 242/472.8 |
| 6,039,281 | * | 3/2000 | Badiali et al. | 242/475.5 |

FOREIGN PATENT DOCUMENTS

| | | |
|---|---|---|
| 26 42 302 A1 | 4/1977 | (DE) . |
| 27 25 105 A1 | 12/1978 | (DE) . |
| 34 40 009 A1 | 5/1986 | (DE) . |
| 38 01 964 A1 | 7/1989 | (DE) . |
| 42 44 081 C1 | 1/1994 | (DE) . |
| 44 04 538 C1 | 4/1995 | (DE) . |
| 44 43 818 A1 | 6/1996 | (DE) . |
| 196 49 314 A1 | 6/1997 | (DE) . |

OTHER PUBLICATIONS

German Search Report.

* cited by examiner

*Primary Examiner*—Danny Worrell
(74) *Attorney, Agent, or Firm*—Kennedy Covington Lobdell & Hickman, LLP

(57) ABSTRACT

A service unit (16) for a cheese-producing textile machine (1), in particular an open-end spinning machine, has manipulation devices for repairing ordinary yarn breaks, an auxiliary yarn transport device (34) for piecing yarn following a cheese/empty tube exchange, and a control device (24) storing a first program with optimal operating parameters for piecing an ordinary yarn break and a second program setting differing operating parameters for producing a safety piecing following a cheese/empty tube exchange.

4 Claims, 3 Drawing Sheets

SERVICE UNIT FOR A CHEESE-PRODUCING TEXTILE MACHINE

CROSS-REFERENCES TO RELATED APPLICATIONS

This application claims the benefit of German patent application DE19917968.9, filed Apr. 21, 1999, herein incorporated by reference.

FIELD OF THE INVENTION

The present invention relates to a service unit for textile machines which wind yarn into a cheese, in particular open-end spinning machines, and relates more particularly to a service unit having manipulation devices for repairing ordinary yarn breaks and having an auxiliary yarn feeding device for piecing the yarn being wound following an exchange of an empty tube for a finished cheese.

BACKGROUND OF THE INVENTION

Such service units are known to be employed in connection with open-end spinning machines as disclosed, for example, in German Patent Publications DE 44 43 818 A1, DE 38 01 964 A1, DE 42 44 081 A1 or DE 44 04 538 A1.

The service units described in these patents service the numerous work stations of the open-end spinning machines, i.e. they act autonomously in case a need for a service operation or action occurs at one of the work stations. Such a need arises, for example, if a yarn break has occurred at one of the work stations, or if a cheese at one of the work stations has attained its prescribed full diameter and must be exchanged for an empty tube.

In such case, the service unit moves to an operative position at the respective work station and, in case of an ordinary yarn break, i.e., a yarn break occurring during the course of winding the cheese to its prescribed diameter, the service unit actuates a yarn searching nozzle to locate and aspirate the torn yarn end lying on or extending from the circumferential surface of the cheese. The yarn end is prepared for continuation of the spinning process and, after the spinning rotor has been cleaned, the yarn end is reinserted into the spinning box of the work station.

In the case of the service units known from German Patent Publications DE 44 43 818 A1 or DE 38 01 964 A1, the prepared yarn end is attached to a fiber ring formed from individual fibers, which rotates along with the spinning rotor, while with the service units in accordance with German Patent Publications DE 42 44 081 A1 or DE 44 04 538 A1 the delivery of fibers to the spinning rotor from the sliver opening device is first completely rerouted and is only re-fed to the fiber collecting surface of the spinning rotor after conditions are appropriate for resuming the spinning operation.

Since a pieced portion of a yarn should differ as little as possible from the remaining extent of the yarn as normally spun by the spinning rotor in regard to the appearance as well as the strength of the pieced portion of yarn, various setting parameters, for example the number of revolutions at the spinning start, the feed-in of the fiber end and the yarn retraction, should be exactly maintained. It is therefore known to check after each piecing operation whether the yarn profile in the area of the piecing device falls within preset acceptable values. Thus, the values determined during the check of the piecing operation can be processed, as described in German Patent Publication DE 196 49 314 A1, in a control device of the service unit in such a way that subsequent yarn piecings are optimized. Here, the optimization of the yarn piecing is performed by means of a defined small change of one or several of the setting parameters which are responsible for the condition of the yarn piecing.

This service process becomes somewhat more difficult when an empty tube must be exchanged for a full finished cheese and a fresh spinning process must be started thereafter. In this case, following the ejection of the finished cheese and the insertion of an empty tube, an auxiliary yarn is initially provided by an auxiliary yarn feeding device arranged in the service unit.

As described, for example, in German Patent Publication DE 44 43 818 A1, the auxiliary yarn, which extends between the mouth of the feed tube of the auxiliary yarn feeding device and the yarn search nozzle, is used for piecing by the yarn piecing devices of the service unit. Thus, the auxiliary yarn is first positioned in front of a yarn catching plate and is transferred to the yarn feeding device by a yarn draw-in device. Subsequently the auxiliary yarn, which is gripped in feeding tongs of the yarn feeding device, is cut by means of a yarn cutting device, and the severed yarn end is removed by the yarn search nozzle via suction. The end of the auxiliary yarn end gripped in the feeding tongs of the yarn feeding device is finally prepared in a customary manner, transferred by the forward pivoting yarn feeding device to the spinning box of the appropriate work station of the open-end spinning machine and is threaded into a small yarn withdrawal tube of the spinning box. Shortly before the auxiliary yarn is placed into the rotating spinning rotor against the ring of individual fibers therein, the auxiliary yarn feeding device is switched to suction air and the auxiliary yarn is cut by a yarn cutting device.

Thereafter the auxiliary yarn and the freshly spun yarn are drawn off by means of the yarn withdrawal device of the service unit and aspirated into the feed tube of the auxiliary yarn feeding device. Then a length of yarn including the auxiliary yarn and the reattached piecing of spun yarn are cut off by a yarn cutting device arranged in the area of the feed tube, and the freshly spun yarn is placed against an empty winding tube maintained between the tube plates of the bobbin creel of the respective work station.

Since the auxiliary yarn used by the above described service units often is not identical with the yarn to be subsequently produced, for example in case of the start of a batch, problems can sometimes arise in the course of the piecing process.

SUMMARY OF THE INVENTION

In view of the above mentioned prior art, it is an object of the present invention to improve the known service units, which have proven satisfactory in basic operation, in respect to their piecing dependability and, in particular, with respect to piecing by means of an auxiliary yarn.

In accordance with the present invention, the piecing process, which per se is always somewhat critical, is made less critical, especially in those cases where the pieced yarn extent will be later removed anyway, in that a pieced yarn portion is produced according to operational parameters of the piecing process which are changed from the parameters conventionally observed. The changed operational parameters for the piecing process differ in part quite clearly from the operational parameters of a normal yarn piecing made optimally according to conventional practices. By changing the operational parameters, it is possible in a simple and dependable manner to produce a visually less beautiful, but extremely durable so-called "safety" pieced yarn extent.

In a preferred embodiment, the operational parameters for a safety pieced yarn extent can be corrected at any time and, if necessary, can also be newly set later, for example manually. In this manner, it is possible to react promptly to any contingencies and in particular to improve the strength of any failed yarn piecings.

According to an advantageous feature of the invention, a first program stored in the control device of the service unit provides operational parameters for a piecing process to produce a yarn piecing which is almost identical to the yarn itself which is being pieced, while a second program also stored in the control device provides operational parameters for a piecing process to produce a yarn piecing which is primarily sturdy but whose visual appearance is of no importance. A service unit designed in this way produces the correct, i.e. optimal, yarn piecing for any occasion.

In a preferred embodiment, the operational piecing process parameters which can be changed for producing a safety yarn piecing are the number of revolutions of the spinning rotor during the piecing process, increasing the sliver feeding and/or elongating the operation of the piecing yarn retracting device. By lowering the number of revolutions of the spinning rotor during piecing, it is possible to reduce the yarn tension and therefore the stress acting on the pieced yarn extent in the process. An elongation of the yarn retraction leads to an extension of the winding zone between the fiber ring and the yarn end being pieced, which rotates with the spinning rotor, and the inserted yarn end. The number of fibers involved in the piecing process can be increased by a change in the sliver feeding operation, in particular by an increase of the sliver feeding rate, whereby the pieced yarn extent as a whole can be made sturdier as a result. These steps, individually or in combination, result in very sturdy safety yarn piecings, although they are not optimal in appearance.

Further features, details and advantages of the present invention will be understood from the following description of an exemplary embodiment of the present invention with reference to the accompanying drawings.

DETAILED DESCRIPTION OF THE PREFERRED EMBODIMENT

Figure 1:
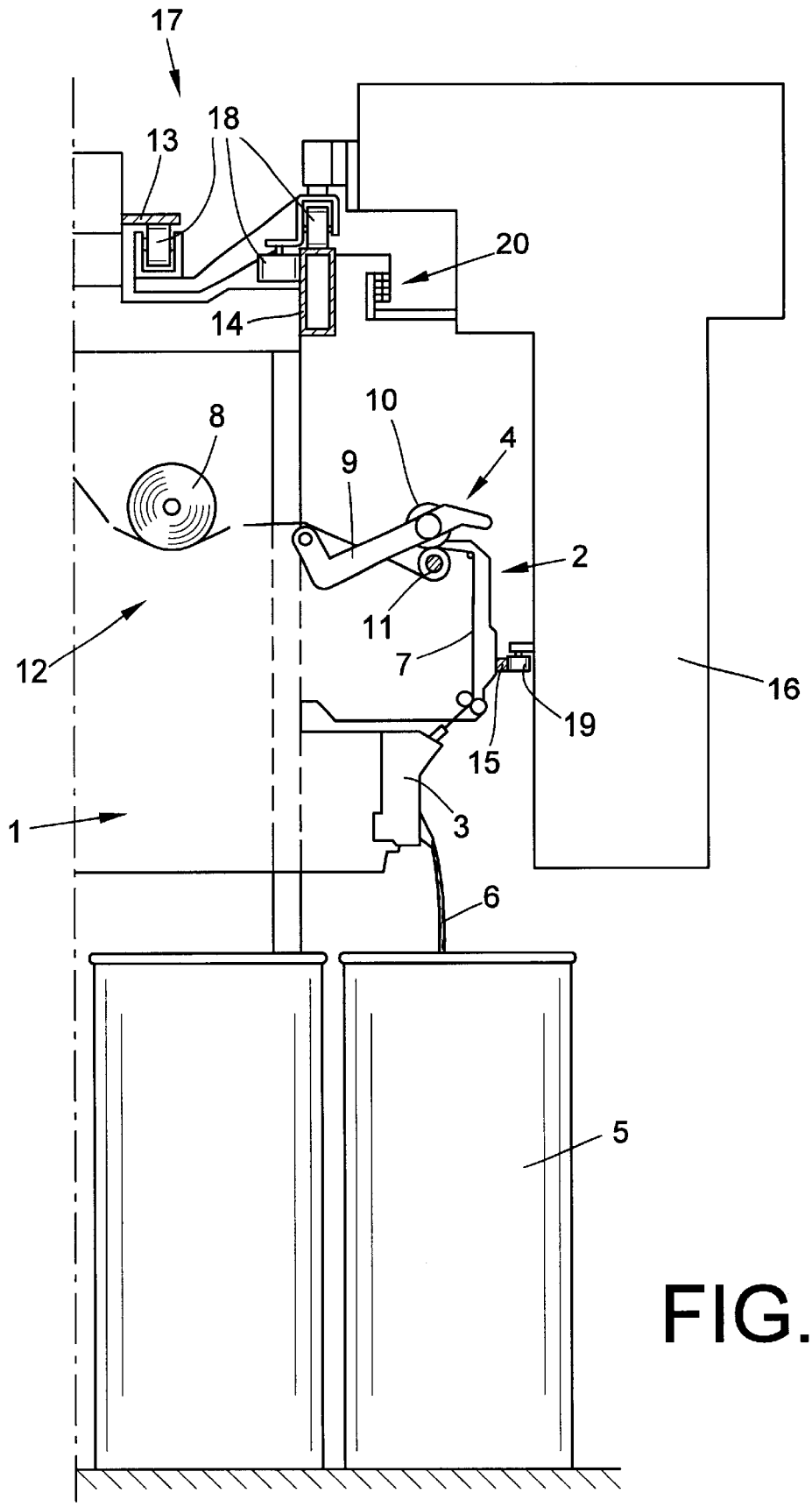
FIG. 1 is a schematic side elevational view of one side of an open-end spinning machine with a traveling autonomously-operating service unit for servicing the work stations and, in particular, for performing the yarn piecing operation of the present invention.

Referring now to the accompanying drawings and initially to FIG. 1, one side of an open-end spinning machine, known per se, is represented schematically and identified in its entirety at 1. Spinning machines of this type have a plurality of work stations 2, i.e., spinning stations, each of which is equipped with a spinning box 3 as well as with a winding device 4 for winding the yarn produced into a so-called cheese 8. More specifically, a sliver 6 delivered from sliver storage cans 5 is fed into the spinning box 3 of each work station wherein the sliver is spun into yarn 7 which is then withdrawn from the spinning box 3 and wound into a cheese 8 at the winding device 4. As represented, the winding devices 4 are equipped with a bobbin creel 9 for rotatably holding a yarn winding tube 10 on which the yarn is wound into the cheese 8, and a winding drum 11 for peripherally driving the surface of the cheese or the empty tube. Typically, the open-end spinning machine also has a cheese transporting device 12 for removing finished cheeses 8 and transporting them to a collection location at the end of the spinning machine.

A service unit, for example a piecing carriage 16, is mounted on or otherwise arranged in association with the spinning machine 1 for traveling movement therealong for performing servicing operations at the individual spinning stations as needed, e.g., the service unit may be supported on guide rails 13, 14, and on a support rail 15 for movement alongside the spinning stations. The running gear 17 of this piecing carriage 16 includes rollers 18 and a support wheel 19. The piecing carriage 16 is supplied with electrical energy via a wiper contact arrangement 20 or any other suitable means, e.g., by a drag chain.

Such service units 16 can thusly move along the work stations 2 of the open-end spinning machine 1 and act independently when there is need for an action at one of the work stations 2. Such need for action occurs, for example, when a yarn break has occurred at one of the work stations 2, or if the cheese at one of the work stations has reached its predetermined diameter and must be exchanged for an empty tube. In such a case the service unit 16 travels to the respective work station, is positioned thereat and, in case of an ordinary yarn break, searches for the broken yarn end resting on the circumferential surface of the cheese 8 with its pivotably movable yarn suction nozzle 21 (FIG. 2).

Figure 2:
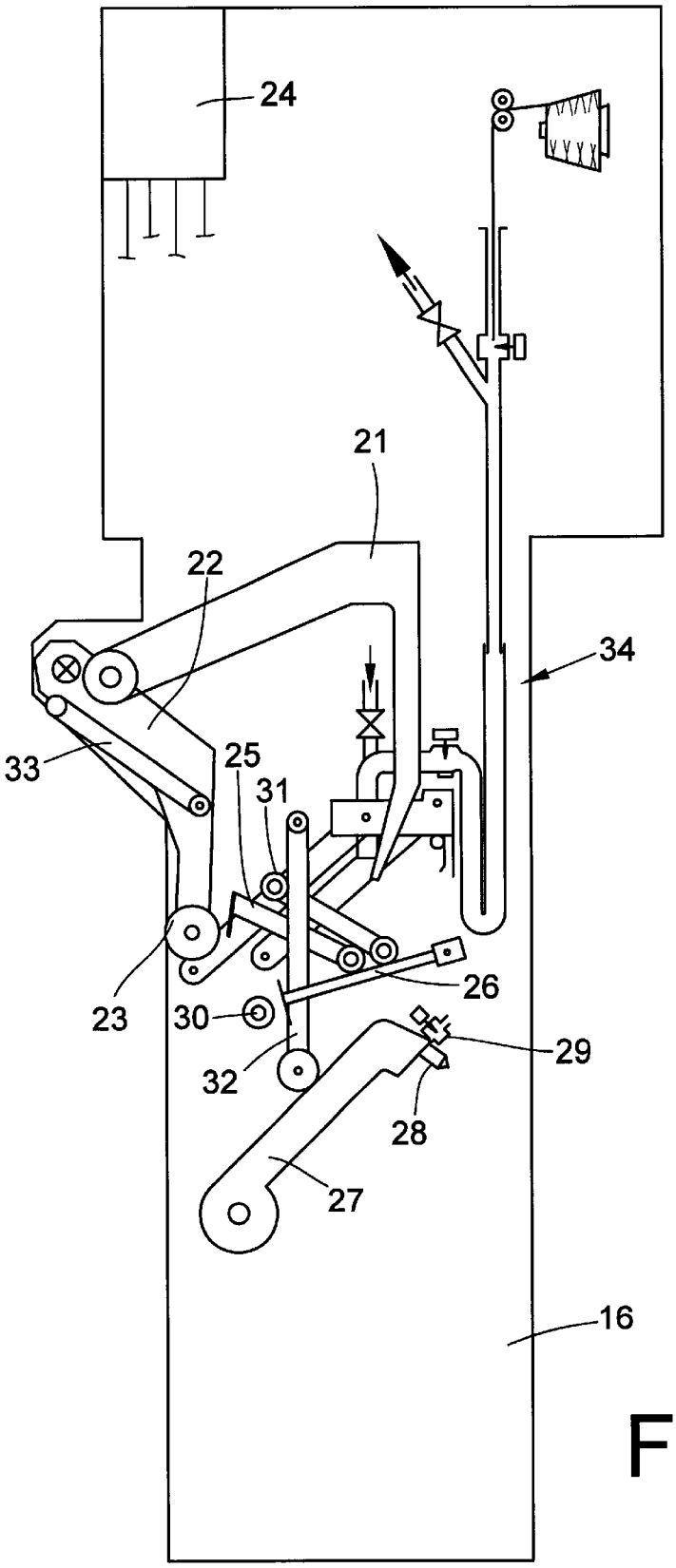
FIG. 2 is a schematic side elevational view of the service unit in accordance with FIG. 1, the housing of which is broken away to show some of the essential yarn manipulating elements provided for piecing a yarn.

As shown in FIG. 2, in addition to the pivotably seated yarn suction nozzle 21, the service unit 16 has an expulsion and drive arm 22 having a drive roller 23 located at its end which can be placed against the cheese surface to eject a finished cheese 8 onto the transport device 12. Moreover, the service unit 16 is equipped in a known manner with a yarn catch plate 25, a yarn draw-in device 26, a yarn feeding device 27 with feeding tongs 28 and a yarn cutting device 29, as well as with a controllable yarn draw-off device 30, 31. In this case the yarn draw-off device comprises a draw-off roller 30 which is drivable in a defined manner, as well as a pivotably arranged pressure roller 31. A creel opener 32 as well as a pressure lever 33 are integrated into the service unit 16 as further service elements. The service unit 16 furthermore has an auxiliary yarn transport device 34, as well as a sliver draw-in arm 35 (FIG. 3), as well as a sensor device 39 (FIG. 3) for detecting the respective number of revolutions of the rotor.

The above described yarn manipulating devices as well as cleaning elements (not represented) of the service unit 16 are as a rule mechanically driven by means of cam disk packages, to which appropriate lever rods are connected.

The sliver draw-in arm 35, whose movement is also controlled by means of a cam disk, has on its end a coupling sleeve 37, which can be acted upon by means of a drive mechanism 36 in a defined manner. During the piecing process, the coupling sleeve 37 is positioned on a sliver infeed cylinder 38 of the open-end spinning device 3.

As is customary, continuous monitoring of the rotational speed of a support disk 40, and therefore of the number of revolutions with which the associated spinning rotor (not represented) rotates, takes place during a piecing process by means of the sensor device 39 which is connected to a control device 24 of the service unit 16.

Figure 3:
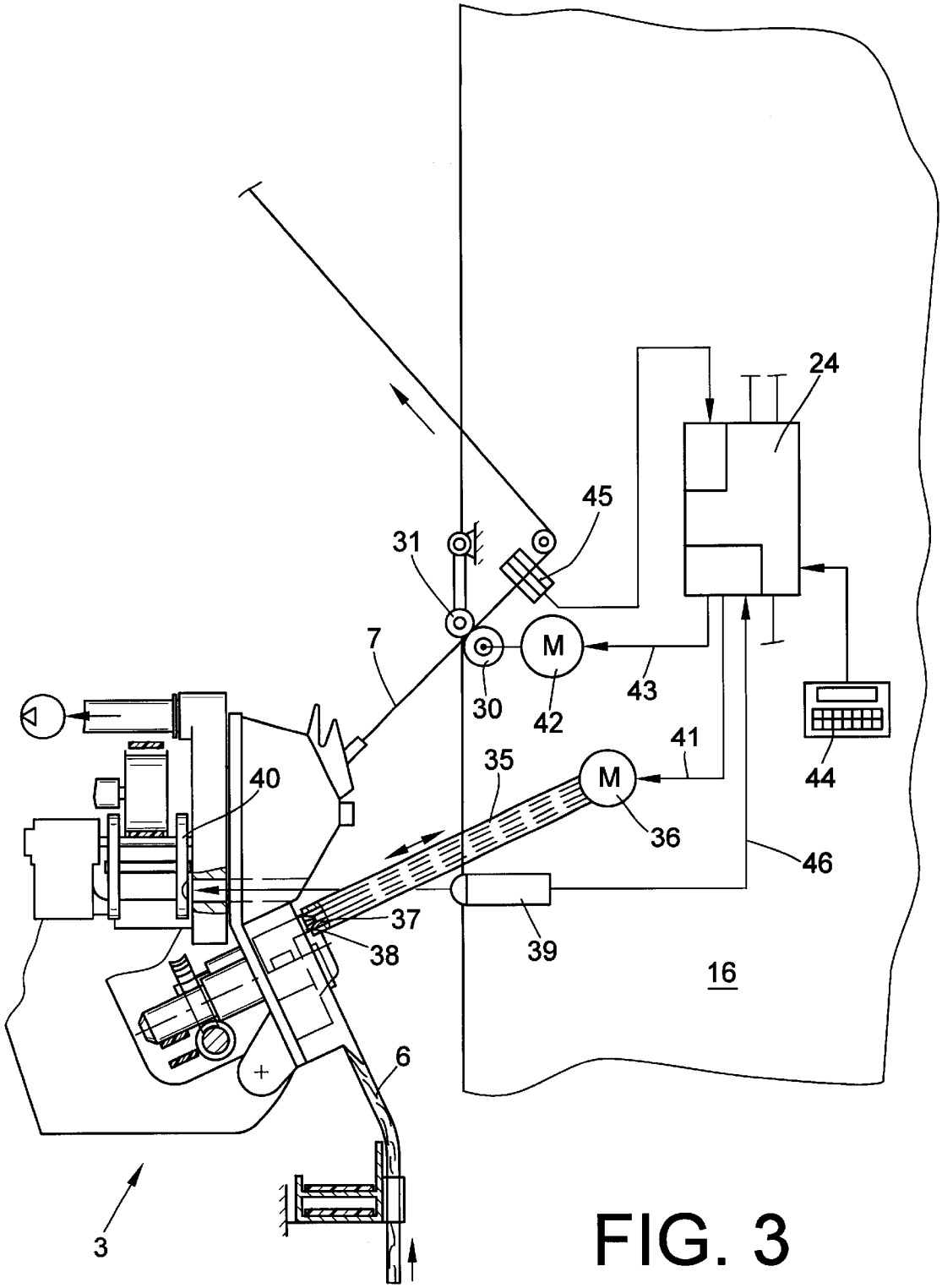
FIG. 3 is a schematic side elevational view of the spinning station of the open-end spinning machine of FIG. 1 and the control device of the service unit of FIG. 2 with further manipulating and functional elements.

As can furthermore be seen from FIG. 3, the drive motor 36 of the sliver draw-in arm 35 is connected via a control line 41, and the sensor device 39 is connected via a signal line 46, to the control device 24 of the service unit 16, while a drive motor 42 for a yarn withdrawal roller 30 is also connected via a control line 43 with the control device 24.

The operation of the device in accordance with the present invention may thus be understood. As soon as the service unit 16 has determined or has been advised that there is need for action at one of the work stations 2, for example by a data transmission system of the open-end spinning machine 1, the service unit 16 travels to the respective work station 2 and is positioned thereat.

Thereupon, the service unit 16 either determines individually what type of error has occurred at the respective work station, for example an ordinary yarn break, a full cheese in need of exchanging, etc., or the data transmission system of the open-end spinning machine 1 communicates to the control device 24 of the service unit 16 the reason for calling the service unit 16 to the work station.

In case of an ordinary yarn break, the yarn end which has been wound onto the surface of the cheese is aspirated in a known manner by means of the suction nozzle 21, is prepared for piecing, and is placed on a fiber ring which rotates along with the spinning rotor in the open-end spinning device 3. The yarn which is subsequently withdrawn is wound on the cheese 8.

In this case, a first program stored in the control device 24 of the service unit 24 controls the operational parameters of the piecing process such that the yarn piecing created has an appearance as well as strength values which are almost equal to that of the yarn itself. Moreover, measurements are taken of the created yarn piecing by means of a piecing check device 45, the results of which measurements are processed in the control device 24 of the service unit 16 for further optimizing subsequent yarn piecings.

Once a cheese 8 has reached its prescribed diameter or a prescribed yarn length has been wound thereon, the cheese 8 must be exchanged for an empty tube 10, whereupon the service unit 16 first ejects the finished cheese 8 onto the cheese transporting device 12 in a known manner by means of the expulsion and drive arm 22 and thereafter the service unit 16 places a fresh empty tube 10 into the bobbin creel 9.

While the cheese transporting device 12 conveys the cheese 8 to a collection location arranged at the end of the machine, a piecing yarn is produced by means of the auxiliary yarn transport device 34. This piecing yarn is prepared in a customary manner by the previously described yarn manipulating devices and is placed onto the fiber ring rotating together with the spinning rotor 4 in the open-end spinning device 3.

Since the yarn piecing being created in the process is removed in every case prior to placing the yarn 7 against the empty tube 10, the control device 24 operates in this case according to a second program which observes special operational parameters for producing a so-called "safety" yarn piecing which parameters differ clearly from the parameters followed for producing an ordinary yarn piecing which is approximately equal to the yarn itself.

Thus, for example, the control device 24 of the service unit 16 operating under this second program initiates an appropriate control of the drive mechanism 36 of the sliver draw-in arm 35 in the course of the sliver prefeeding E2 to feed more fibers than usual into the spinning rotor, which results in a relatively thick, but more stable yarn piecing.

In place of or in additional to the increased sliver prefeeding E2, the second control program may also control the drive motor 36 to appropriately increase the length of time of its operation which achieves a so-called fiber addition (ΔE3) thereby similarly resulting in a relatively thick, very durable safety piecing Further setting parameters of the second control program may be to increase the yarn retracting length R3 during the piecing process and/or to increase the number of revolutions of the spinning rotor during piecing, by means of which a safety piecing can be produced in a simple manner. For example, for increasing the yarn retracting length R3, the drive motor 42 of the yarn withdrawal roller 30 is controlled by the control device 24 of the service unit 16 in such a way that a slightly longer than normal yarn length is fed back into the spinning rotor. This increased yarn retraction length results in the yarn length as a whole involved in the piecing operation being slightly increased.

Since the respective number of revolutions of the spinning rotor during the piecing process is monitored by the sensor device 39, and the piecing process is customarily initiated at a predetermined number of revolutions, it is also possible to affect the piecing by changing the predetermined number of revolutions for piecing. Thus, the control device 24 of the service unit 16 causes the sliver infeed, and correspondingly the yarn retraction, to be started at a number of revolutions which is clearly less than the number of revolutions for piecing customary for producing yarn piecings which are equal to the yarn. A safety piecing can also be produced in this manner while the risk of a faulty piecing can be clearly reduced.

As already previously explained, the above described steps result in yarn piecings which, although not visually attractive because they are not equivalent to the yarn, are extremely durable and in any event are cut out and removed prior to the yarn being fixed on the empty tube to resume the yarn spinning and winding process.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A service unit for a cheese producing textile machine, comprising manipulation devices for repairing a yarn break, an auxiliary yarn feeding device for piecing a starting yarn end following an exchange of an empty winding tube for a completed cheese, and a control device storing a first program with operational parameters for controlling a yarn piecing operation producing a yarn piecing for repairing a yarn break with the dimensions of the yarn piecing having a profile essentially equivalent to the yarn being spun and a second program with operational parameters which differ from the parameters of the first program for controlling a yarn piecing operation to produce a safety yarn piecing for piecing a starting yarn end following an exchange of an empty winding tube for a completed cheese with the dimensions of the safety yarn piecing exceeding the cross section of the yarn being spun.

2. The service unit in accordance with claim 1, characterized in that the control device includes means for changing the operational parameters of the second program for the safety yarn piecing.

3. The service unit in accordance with claim 2, characterized in that the changeable operational parameters of the second program are the number of revolutions of a spinning rotor during piecing, feeding of a sliver into the rotor and retraction of the yarn from the spinning rotor.

4. The service unit in accordance with claim 3, characterized in that the operational parameter for feeding the sliver is an increase in the length of time over which fibers are fed into the spinning rotor during a piecing operation to produce a safety yarn piecing in comparison to the feeding of sliver during a piecing operation to repair a yarn break.

* * * * *